United States Patent [19]

Brown

[11] Patent Number: 4,546,974

[45] Date of Patent: Oct. 15, 1985

[54] FOOTBALL HOLDING DEVICE

[76] Inventor: Brian M. Brown, 10117 Ivy Gate Cir., Dallas, Dallas County, Tex. 75238

[21] Appl. No.: 528,977

[22] Filed: Sep. 2, 1983

[51] Int. Cl.[4] ..... A63B 67/00

[52] U.S. Cl. ..... 273/55 B

[58] Field of Search ..... 273/55 B

[56] References Cited

U.S. PATENT DOCUMENTS

| | | | |
|---|---|---|---|
| 3,087,726 | 4/1963 | Pogue | 273/55 B |
| 3,105,686 | 10/1963 | Elsea | 273/55 B |
| 3,439,916 | 4/1969 | Kopp | 273/55 B |
| 3,462,145 | 9/1984 | Shirley et al. | 273/55 B |
| 3,472,511 | 10/1969 | Shirley et al. | 273/55 B |
| 3,762,706 | 10/1973 | Cavett | 273/55 B |
| 3,831,940 | 8/1974 | Molettieri | 273/55 B |
| 3,897,948 | 8/1975 | Gerela | 273/55 B |
| 4,049,267 | 9/1977 | Forrest | 273/55 B |

*Primary Examiner*—Richard C. Pinkham
*Assistant Examiner*—T. Brown
*Attorney, Agent, or Firm*—Richards, Harris, Medlock & Andrews

[57] ABSTRACT

A football holding device comprising a base portion, support structure extending upwardly from the base portion, and a holding arm. The holding arm has a first end attached to an upper portion of the support structure in a manner that allows the holding arm to pivot in a horizontal and vertical plane, and a second end is adapted for engaging the tip of a football. Positioning structure are also provided for releasably retaining the holding arm in a first position in which the football is engaged from above by the second end of the holding arm. A spring for retracting the holding arm upwardly and away from its first position when the ball is kicked is also provided. The positioning structure includes an elastic member which retains the holding arm in a detent formed by a positioning member. As the ball is kicked, the holding arm is urged out of the detent and the retracting spring urges the holding arm up and away from the path of the football and the kicker's foot. Both the height of the holding arm above the ground and the angle of the support structure relative to the base member are adjustable. This adjustability allows footballs of various sizes to be held at various angles relative to the ground.

9 Claims, 4 Drawing Figures

FOOTBALL HOLDING DEVICE

TECHNICAL FIELD

The present invention pertains to a football holding device. More specifically, the invention relates to an adjustable device for holding a football in a substantially vertical position, thereby enabling one to practice kicking without the assistance of another person to hold the football.

BACKGROUND ART

Numerous hours of practice are required to achieve and maintain proficiency in the art of kicking a football. To practice, however, generally requires the assistance of another person to hold the ball in an upright position. Although various kicking tees and holding devices are available to take the place of the holder, most do not adequately retain the ball under windy conditions, or interfere with the flight of the ball after it is kicked. Further, many of the prior art devices do not accommodate footballs of different sizes and utilize elaborate configurations requiring frequent adjustment. Examples of such devices can be found in U.S. Pat Nos. 3,439,916; 3,762,706; 3,831,940; and 4,049,267.

Thus, a need exists for a football holding device that allows one to practice without the assistance of another person, yet also is capable of simple adjustment to accommodate footballs of different sizes. Further, the device should hold the ball in a manner that does not interfere with the flight of the ball after it is kicked and should be capable of being used by both right and left footed kickers without the necessity for elaborate adjustment. It is also desired that the device allow a kicker to slant the ball at an angle to further simulate the action of a real-life holder.

SUMMARY OF THE INVENTION

In accordance with the present invention, a football holding device comprising a base portion, a support structure extending upwardly from the base and a holding arm pivotally attached to the support structure and extending substantially parallel to the ground from the support structure for retaining the football from above. The holding arm is capable of pivoting in both a horizontal and vertical plane so that as the ball is kicked, springs or other elastic members cause the holding arm to swing up and away from the path of the kicker's foot so as not to interfere with the flight of the ball.

The support structure is attached to the base portion in a manner that allows the angle at which the holding arm retains the football relative to the ground to be varied as desired. Additionally, the support structure can be quickly and easily adjusted to vary the height at which a lever arm is retained above the ground, thereby accommodating footballs of various sizes, with or without the use of a kicking tee.

A key feature of the present invention is the manner in which the holding arm retains the football and quickly retracts after it is kicked so as not to interfere with the flight of the ball. Other key features include the ease with which the device adjusts to hold footballs of various sizes and at various angles relative to the ground. A further object of the present invention is to provide a durable holding device capable of simulating the action of a real-life holder. Other objects of the present invention will become apparent from the following Description and accompanying Drawings.

DETAILED DESCRIPTION OF THE INVENTION

Figure 1:
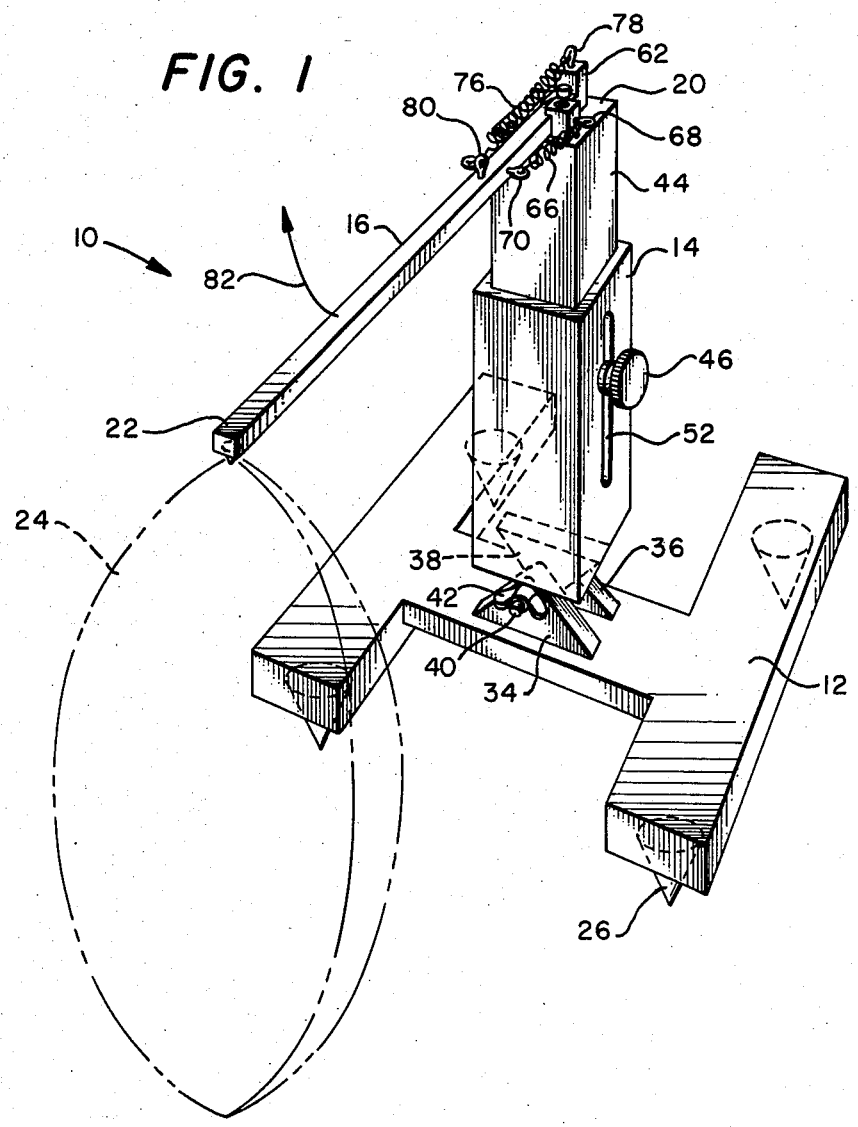
FIG. 1 is a perspective view of one embodiment of the football holding device of the present invention shown retaining a football.
Figure 2:
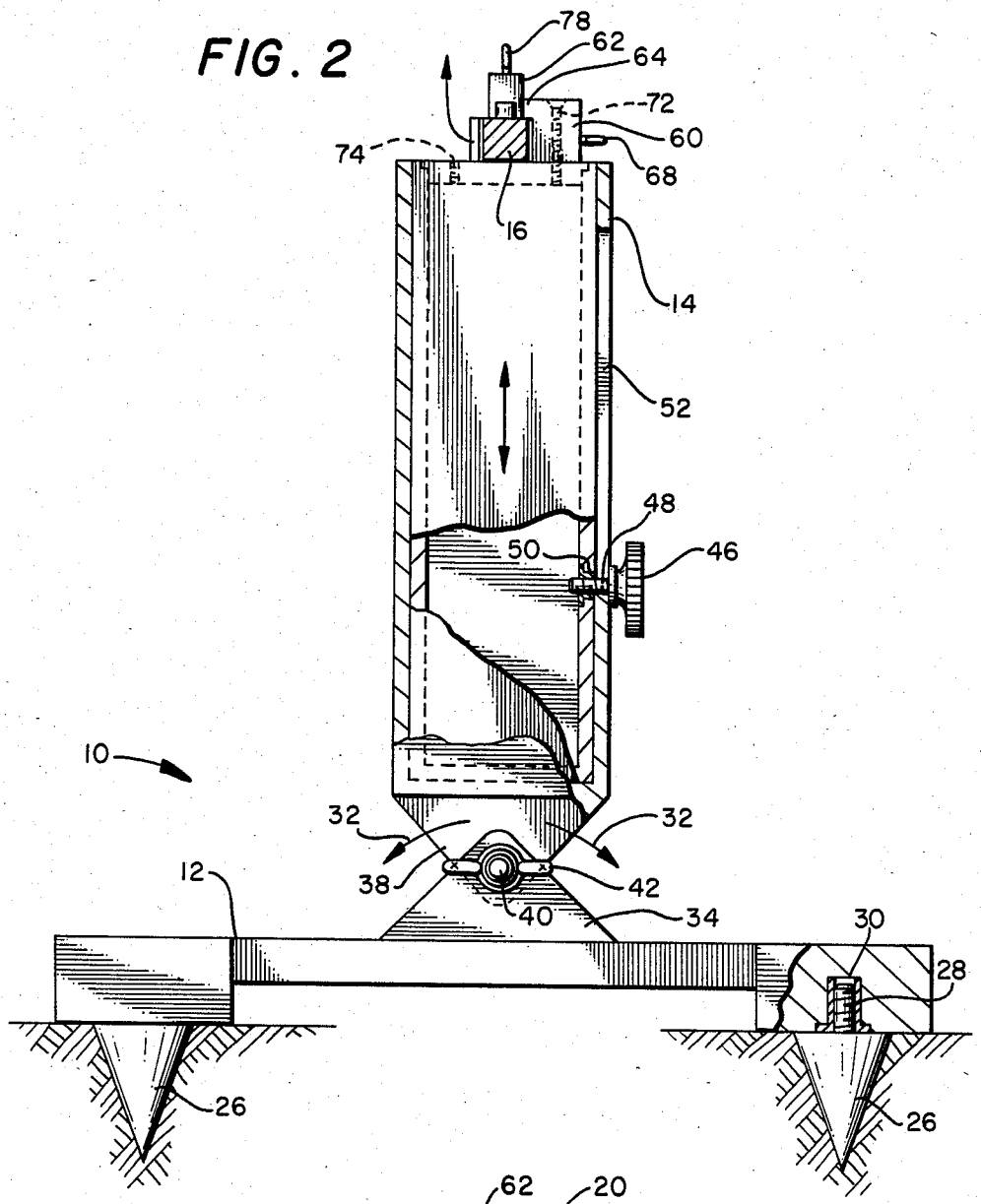
FIG. 2 is an elevational view with parts broken away to show details of construction.
Figure 3:
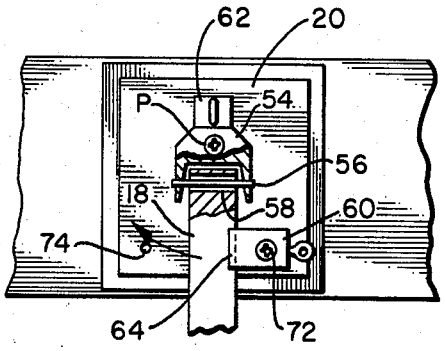
FIG. 3 is a partially cut-away top view showing the preferred manner in which the holding arm is attached to the top of the support structure.

Referring now to FIGS. 1–3, a preferred embodiment of the present football holding device comprises a base portion 12 for engaging the ground, a support structure 14 extending upwardly from the base portion 12, a holding arm 16 having a first end 18 pivotally attached to an upper portion 20 of the support structure 14 and a second end 22 adapted for engaging the tip of a football 24. It is preferred that the base portion 12 is generally H-shaped and also includes ground spikes 26 to stabilize the device 10 as it rests on the ground. The spikes 26 are preferably removable so that the device can be used on hard or artificial surfaces as well. Such removability can be accomplished by various means. As shown in FIG. 2, for example, spikes 26 include a threaded portion 28 which is received by a correspondingly threaded opening 30 in the base portion 12.

Support structure 14 is attached to base portion 12 in a manner that allows the angle at which the support structure 14 is retained relative to the base 12 to be varied as shown by arrows 32, thereby enabling the angle at which the ball is retained relative to the ground to be correspondingly varied. As shown in FIGS. 1 and 2, support structure 14 is pivotally attached to the base portion 12. This pivotal arrangement can be accomplished by providing base member 12 with a pair of parallel members 34 and 36 spaced a distance apart. The lowermost portion 38 of support structure 14 is tapered and adapted to fit between parallel members 34 and 36. A bolt 40 and wing nut 42 are then provided for retaining the support structure 14 at the preferred angle.

In addition to varying the angle at which the football is retained relative to the ground, the present holding device is also capable of adjustment to retain footballs of various sizes that are used with or without a kicking block. Such height adjustment is achieved by providing support structure 14 with telescoping member 44 which is slidably retained in support structure 14. Telescoping member 44 is provided with a knob 46 which is attached to threaded member 48 and fits in a correspondingly threaded opening 50. To adjust the height at which the holding arm 16 is retained above the ground, knob 46 is loosened and telescoping member 44 is raised or lowered to the desired height. Slot 52 allows the knob 46 to move vertically with respect to support structure 14. When the desired height is reached, knob 46 is then tightened. thereby frictionally retaining telescoping member 44 against support structure 14.

The holding arm 16 which retains the football in a substantially upright position is attached at one end to the upper portion 20 of support structure 14 in a manner that allows the holding arm to pivot in a vertical and horizontal plane. This is accomplished by mounting the holding arm 16 in a generally Y-shaped member 54 which is pivotally attached to the upper portion 20 of support structure 14 at point p to pivot in a horizontal plane i.e. parallel to the ground. Partial rotation in a vertical plane is accomplished by utilizing a pin 56 that extends through opening 58 of holding arm 16 to attach the holding arm 16 to the Y-shaped member 54. The opening 58 is slightly larger than the diameter of pin 56, thereby allowing free movement of holding arm 16 in a vertical plane about pin 56.

Positioning 60 and retracting 62 members are provided to position the holding arm 16 while retaining the football and to retract the holding arm 16 after the ball has been kicked. Positioning member 60 extends upwardly from the upper portion 20 of support structure 14 and has an overhanging portion 64 that forms a detent which is sized to receive holding arm 16. Elastic member 66 is attached to the positioning member 60 and to holding arm 16, thereby retaining holding arm 16 under the overhanging portion 64 of positioning member 60. Eyelets 68 and 70 can be used to retain elastic member 66, which is preferably a spring. Further, positioning member 60 is detachably retained on the upper portion 20 of support structure 14 so that it can be mounted on either side of holding arm 16, thereby accommodating both right and left footed kickers. As shown in FIG. 2, positioning member 60 is retained on the upper portion 20 of support structure 14 by screw 72. Opening 74 can also receive screw 72, thereby fixing positioning member 60 on the opposite side of holding arm 16.

Retracting member 62 extends upwardly from Y-shaped member 54 to retain one end of elastic member 76 in eyelet 78. Eyelet 80 secures the other end of elastic member 76 to holding arm 16. As shown in FIG. 1, the overhanging portion 64 of positioning member 60 prevents the holding arm 16 from moving out of the detent formed by overhanging member 64.

To use the football holding device 10 of the present invention, a football is placed under one end 22 of holding arm 16 and the desired height and angle adjustments are made using knob 46 and wing nut 42. Holding arm 16 is retained in a first position under overhanging portion 64 of positioning member 60 by spring 66. In this first position, the football is engaged from above by the end 22 of holding arm 16 which is adapted to engage the tip of a football 24, thereby retaining the football between the holding arm 16 and the ground or kicking block (not shown). As the ball is kicked, the movement of the ball and the kicker's foot forces holding arm 16 out of the detent formed by the overhanging portion 64 of member 60. At this point, elastic member 76 pulls the holding arm 16 upwardly in the direction of arrow 82 and out of the path of the football and kicker's foot.

Figure 4:
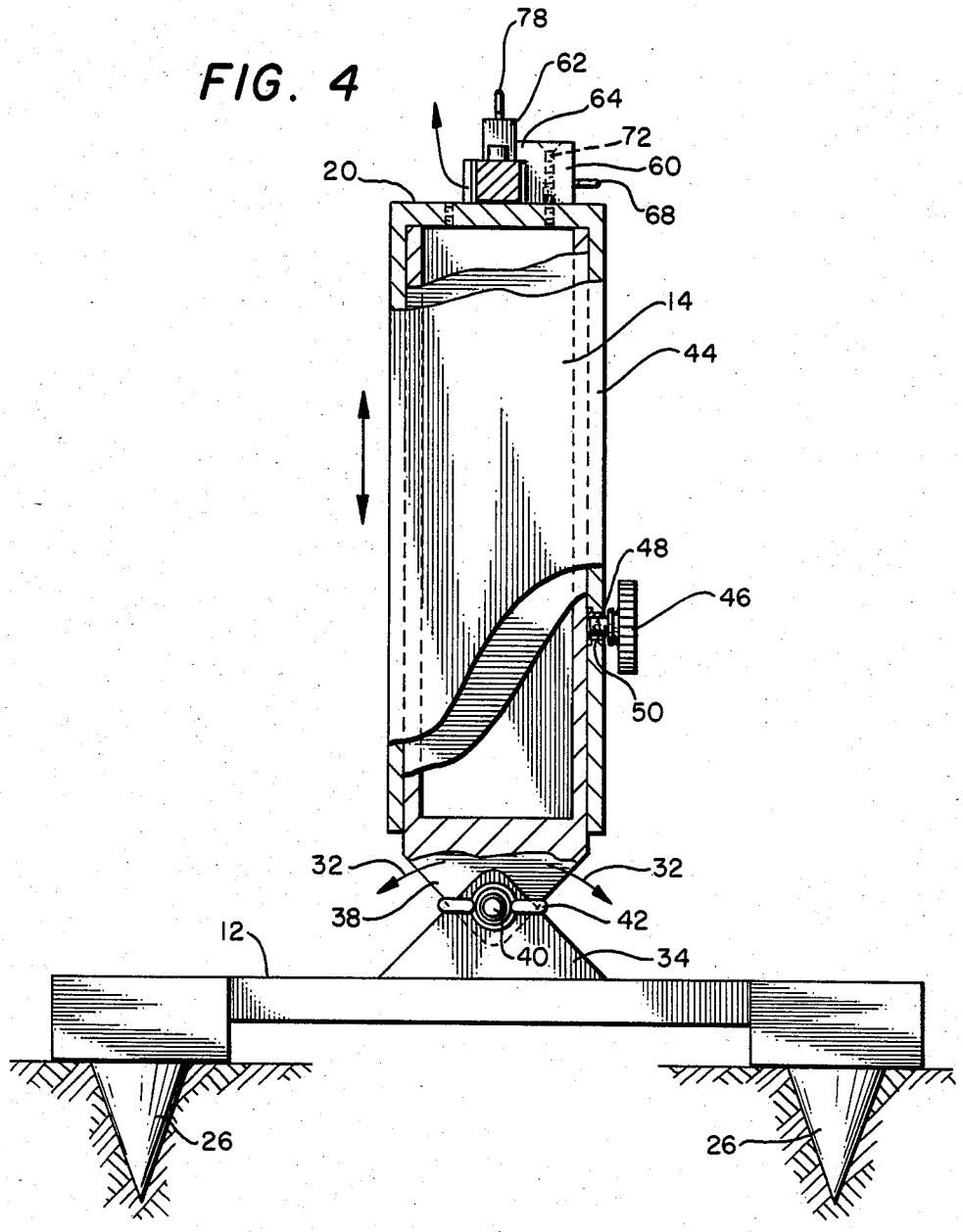
FIG. 4 is an elevational view showing an alternate embodiment of the support structure of the present invention with parts broken away to show details of construction.

FIG. 4 illustrates an alternate embodiment of the present invention wherein the telescoping member 44 of the support structure 14 is positioned on the outside of support structure 14, as opposed to on the inside of the support structure as shown in FIG. 1.

The various parts of the football holding device of the present invention can be made out of any suitable material. For durability and to minimize expense, it is preferred that the football holding device be made of a durable plastic material, although wood or other suitable materials can also be used.

While rather specific terms have been used to describe the embodiments of the present invention, they are not intended, nor should they be construed as a limitation upon the invention as defined by the following claims.

What is claimed is:

1. A device for holding a football in a substantially upright position comprising:

a base portion for engaging the ground;

a support structure extending upwardly from the base portion;

a holding arm having a first end attached to an upper portion of the support structure in a manner that allows the holding arm to pivot in a vertical and horizontal plane, and a second end adapted for engaging the tip of a football, said football being thereby positioned properly for place kicking;

positioning means for releasably retaining the holding arm in a first position in which a football is engaged from above by the second end of the holding arm; and retracting means for urging the second end of the holding arm up from the first position after the holding arm is released from the positioning means, whereby the second end of the holding arm swings away and up from the first position when the football is kicked, so as not to interfere with the flight of the ball.

2. The football holding device as recited in claim 1 wherein the positioning means comprise:

a positioning member extending upwardly from the support structure, the positioning member having a detent therein; and An elastic member extending from the positioning member to the side of the holding arm adjacent the positioning member, thereby retaining the holding arm in the detent in the first position.

3. The football holding device as recited in claim 1 wherein the retracting means comprises:

a retracting member extending upwardly from the support structure to a point higher than the holding arm; and an elastic member extending from the retracting member to the top side of the holding arm whereby said elastic member pulls the holding arm upward from its first position and away from the path of the football and kicker's foot when the football is kicked.

4. The football holding device as recited in claim 1 further comprising means for telescopically adjusting the height at which the support structure extends upwardly from the base portion, thereby accommodating footballs of various sizes.

5. The football holding device as recited in claim 1 further comprising means for adjusting the angle at which the support structure is retained relative to the base portion, thereby allowing the football to be retained at a corresponding angle with respect to the ground.

6. The football holding device as recited in claim 1 further comprising removable spikes attached to the base portion for stabilizing the holding device as it rests on the ground.

7. The football holding device as recited in claim 1 wherein the positioning means comprise:

a positioning member attached to the support structure, the positioning member having a detent therein; and means for retaining the holding arm in the detent in the first position.

8. A device for holding a football in a substantially upright position comprising:

a base portion for engaging the ground;

a support structure extending upwardly from the base portion, the support structure having means for adjusting the height at which the support structure extends upwardly from the base portion and means for adjusting the angle at which the support structure is retained relative to the base portion;

a holding arm having a first end attached to an upper portion of the support structure in a manner that allows the holding arm to pivot in a vertical and horizontal plane, and a second end adapted for engaging the tip of a football;

positioning means for releasably retaining the holding arm in a first position in which the football is engaged from above by the second end of the holding arm, the positioning means comprising a positioning member having a detent therein extending upwardly from the support structure and a first elastic member extending from the positioning member to the side of the holding arm adjacent the positioning member, thereby retaining the holding arm in the detent in the first position; and retracting means for urging the second end of the holding arm up from the first position after the holding arm is released from the positioning means, whereby the second end of the holding arm swings away and up from the first position when the football is kicked, the retracting means comprising a retracting member extending upwardly from the support structure to a point higher than the holding arm and an elastic member extending from the retracting member to the top side of the holding arm so that as the holding arm is urged away from its first position when the ball is kicked, said elastic member urges said holding arm upwardly and away from the path of the football and kicker's foot.

9. A device for holding a football in a substantially upright position comprising:

a base portion for engaging the ground;

a support structure extending upwardly from the base portion, the support structure having means for adjusting the height at which the support structure extends upwardly from the base portion and means for adjusting the angle at which the support structure is retained relative to the base portion;

a holding arm having a first end attached to the support structure in a manner that allows the holding arm to pivot in a vertical and horizontal plane, and a second end adapted for engaging the tip of a football;

positioning means for releasably retaining the holding arm in a first position in which the football is engaged from above by the second end of the holding arm, the positioning means comprising a positioning member having a detent therein attached to the support structure and means for retaining the holding arm in the detent in the first position; and retracting means for urging the second end of the holding arm up from the first position after the holding arm is released from the positioning means, whereby the second end of the holding arm swings away and up from the first position when the football is kicked so as not to interfere with the flight of the ball.

* * * * *